US006899516B2

(12) United States Patent
Wang

(10) Patent No.: US 6,899,516 B2
(45) Date of Patent: May 31, 2005

(54) TRANSVERSE TYPE BLOWERS

(76) Inventor: Hua-Chiang Wang, No. 2342, Sloan Dr., La Verne, CA (US) 91750

( * ) Notice: Subject to any disclaimer, the term of this patent is extended or adjusted under 35 U.S.C. 154(b) by 0 days.

(21) Appl. No.: 10/661,561

(22) Filed: Sep. 15, 2003

(65) Prior Publication Data

US 2005/0058538 A1 Mar. 17, 2005

(51) Int. Cl.[7] ..... F04D 29/42; F04D 29/62; F04D 29/70

(52) U.S. Cl. ..... 415/60; 415/121.2; 415/146; 415/213.1; 415/214.1; 416/63; 417/234; 417/371; 417/423.9; 417/423.14; 417/423.15; 454/259; 454/353

(58) Field of Search ..... 415/146, 121.2, 415/204, 206, 213.1, 214.1, 60; 416/63, 247 R; 454/259, 353; 417/234, 371, 423.9, 423.14, 417/423.15; 137/527.8

(56) References Cited

U.S. PATENT DOCUMENTS

| | | | | | |
|---|---|---|---|---|---|
| 165,517 | A * | 7/1875 | Morrell | 165/102 |
| 1,364,360 | A * | 1/1921 | Emery | 417/234 |
| 2,005,408 | A * | 6/1935 | Allin | 415/121.2 |
| 2,048,911 | A * | 7/1936 | Zimmerman | 415/121.2 |
| 2,135,827 | A * | 11/1938 | Marty | 415/206 |
| 2,160,278 | A * | 5/1939 | Ness et al. | 417/371 |
| 2,297,049 | A * | 9/1942 | Cotton et al. | 417/423.14 |
| 2,548,607 | A * | 4/1951 | Jenn | 454/353 |
| 2,741,972 | A * | 4/1956 | Pryne | 454/353 |
| 3,384,000 | A * | 5/1968 | Fuller | 454/353 |
| 4,424,006 | A * | 1/1984 | Armbruster | 417/234 |
| 5,000,769 | A * | 3/1991 | Raguideau et al. | 415/121.2 |
| 5,105,731 | A * | 4/1992 | Kraus | 454/259 |
| 5,167,574 | A * | 12/1992 | Ikeda et al. | 454/164 |
| 5,174,048 | A * | 12/1992 | Shero | 415/206 |
| 5,403,152 | A * | 4/1995 | Trautloff et al. | 415/206 |
| 6,439,861 | B1 * | 8/2002 | Shieh | 417/371 |
| 6,514,053 | B2 * | 2/2003 | Takura et al. | 417/371 |
| 6,655,926 | B2 * | 12/2003 | Wang et al. | 417/234 |
| 6,705,833 | B2 * | 3/2004 | Tam et al. | 415/146 |
| 2003/0161722 | A1 * | 8/2003 | Galassi | 415/121.2 |

FOREIGN PATENT DOCUMENTS

| | | | | |
|---|---|---|---|---|
| JP | 4-158160 | A * | 6/1992 | 454 353 |
| JP | 4-208347 | A * | 7/1992 | 454 353 |

* cited by examiner

*Primary Examiner*—Christopher Verdier
(74) *Attorney, Agent, or Firm*—Rosenberg, Klein & Lee

(57) ABSTRACT

A blower includes a base having a transverse passage for receiving a motor therein and a fan device driven by the motor extends from a hole in an end of the base. A casing including an outlet is connected to the base and mounted to the fan device. An anti-back device is engaged in the outlet and includes a frame to which a plate is pivotably connected. The plate is opened by the air sent via the fan device in one direction and seals the outlet when air goes in opposite direction.

6 Claims, 8 Drawing Sheets

TRANSVERSE TYPE BLOWERS

FIELD OF THE INVENTION

The present invention relates to a blower which includes a transversely inserted motor and an anti-back device so as to prevent the air in the inflated object from escaping.

BACKGROUND OF THE INVENTION

A conventional blower may be used for inflating an object, such as a huge toy balloon. The conventional blower 10 is shown in FIGS. 1 and 2 and generally includes a base 11 which is put on the ground and has a recessed area 112 and an inlet 113 is defined in the wall of the recessed area 112. A motor assembly 12 including a motor 121 and a fan device 123 is inserted into the chamber in the base 11 via an open top 111 of the base 11. The motor 121 has lugs 122 which are fixed to recesses 115 on a top of the base 11. A casing 13 is mounted to the top of the base 11 and includes an outlet 131 so as to send air therefrom. It is also noted, that because the position of the inlet 113 is close to the ground, dust and peddles are sucked into the blower and can damage the parts of the fan device 123 and the motor 121. Furthermore, the air sucked from the inlet 113 leaks from the gaps 116 between the fan device 123 and the periphery of the open top 111. The distance between the motor 121 and the base 11 is too small to release the heat from the motor 121 so that the base 11 could be burned. Once the electric power is shut unexpectedly, the air in the huge balloon escapes from the outlet 131 and the inlet 113, and the balloon collapses to trap the kids in the balloon.

The present invention intends to provide a blower that has an anti-back device to prevent the air in the balloon going back from the blower when no electric power is provided.

SUMMARY OF THE INVENTION

In accordance with one aspect of the present invention, there is provided a blower which comprises a base having a transverse passage defined therethrough and the transverse passage defines a first hole and a second hole in two opposite ends of the base. A motor is received in the transverse passage and a fan device driven by the motor extends from the second hole.

A casing is connected to the base and mounted to the fan device. The casing includes an outlet and an anti-back device is engaged in the outlet. The anti-back device has a frame to which a plate is pivotably connected. The plate is opened in one direction and seals the outlet when air goes in opposite direction.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
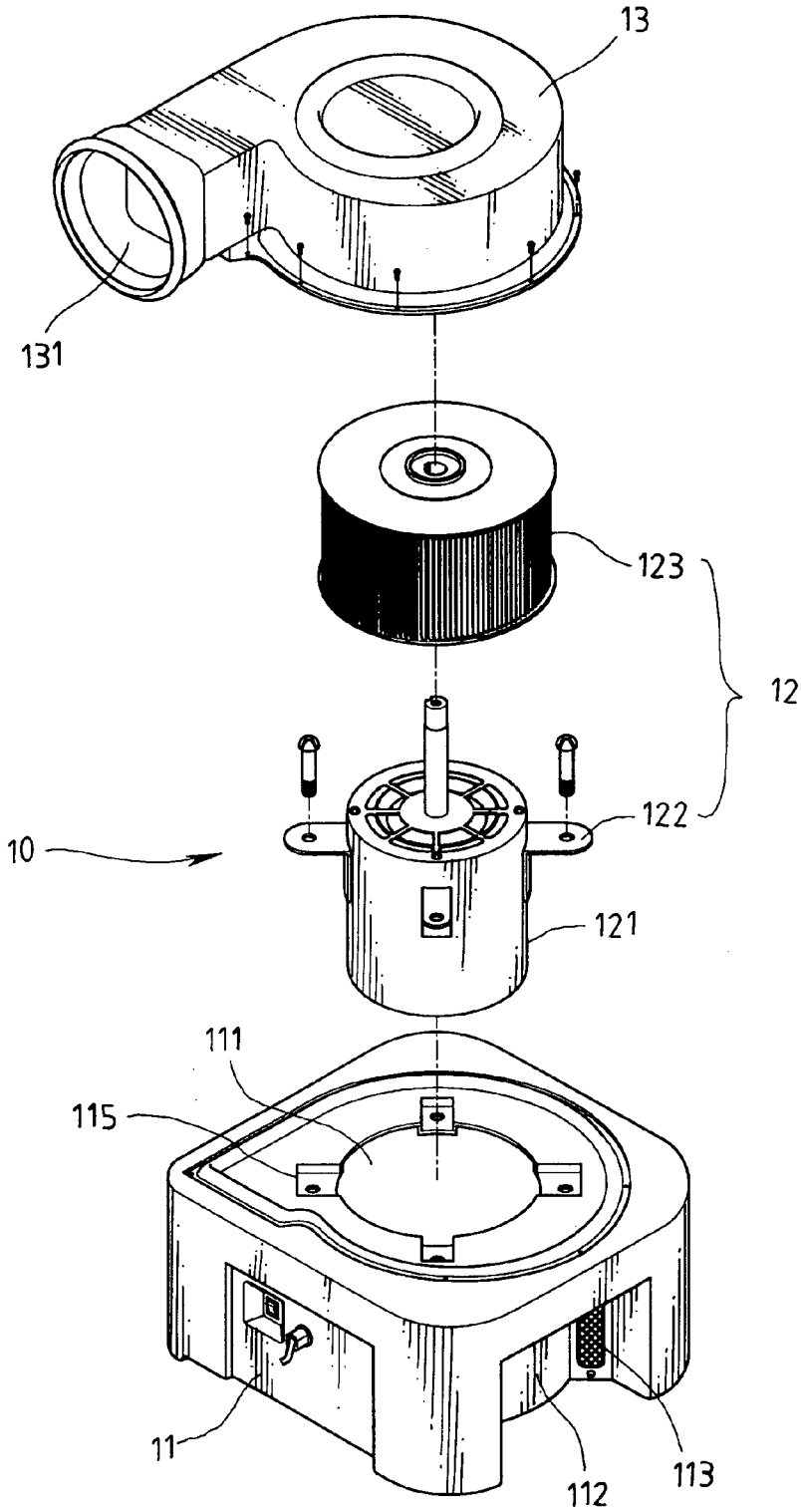
FIG. 1 PRIOR ART
FIG. 1 is an exploded view to show a conventional blower.
Figure 2:
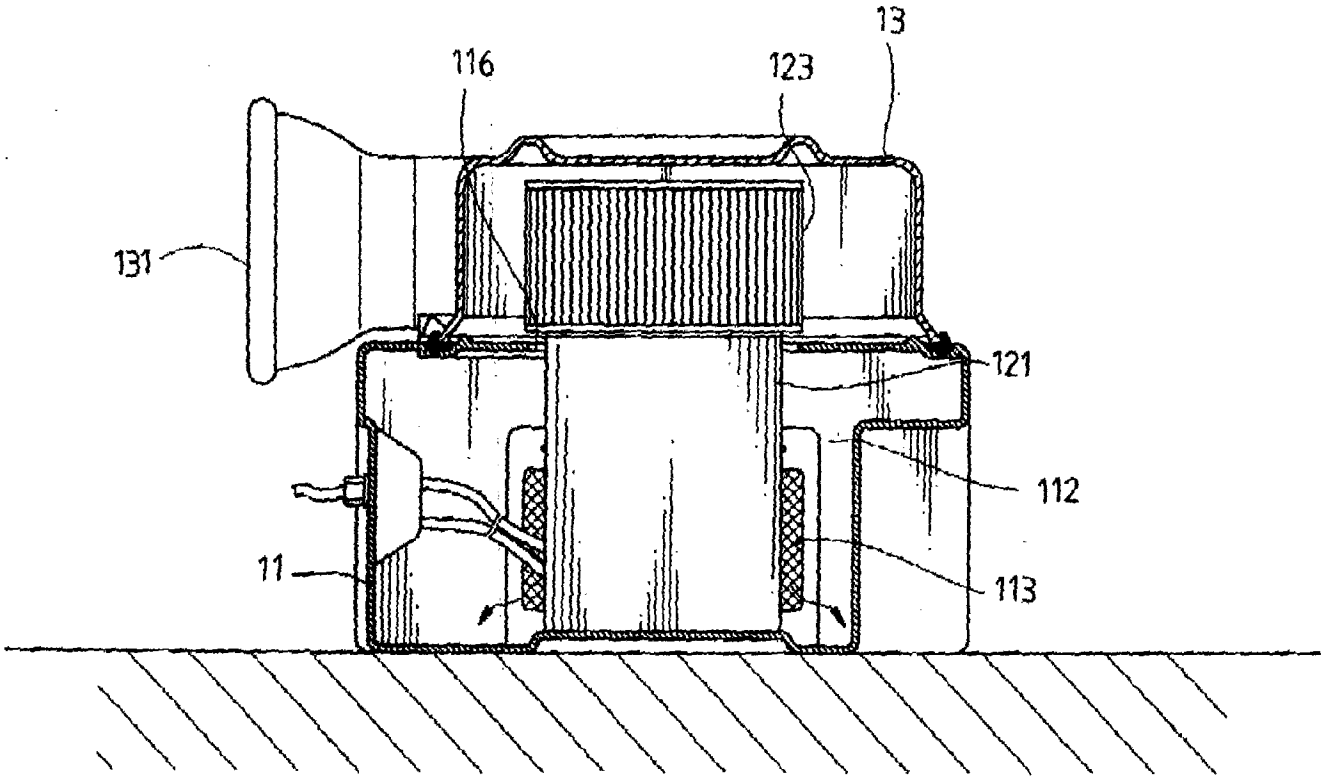
FIG.2 PRIOR ART
FIG. 2 is a side cross sectional view of the conventional blower.
Figure 3:
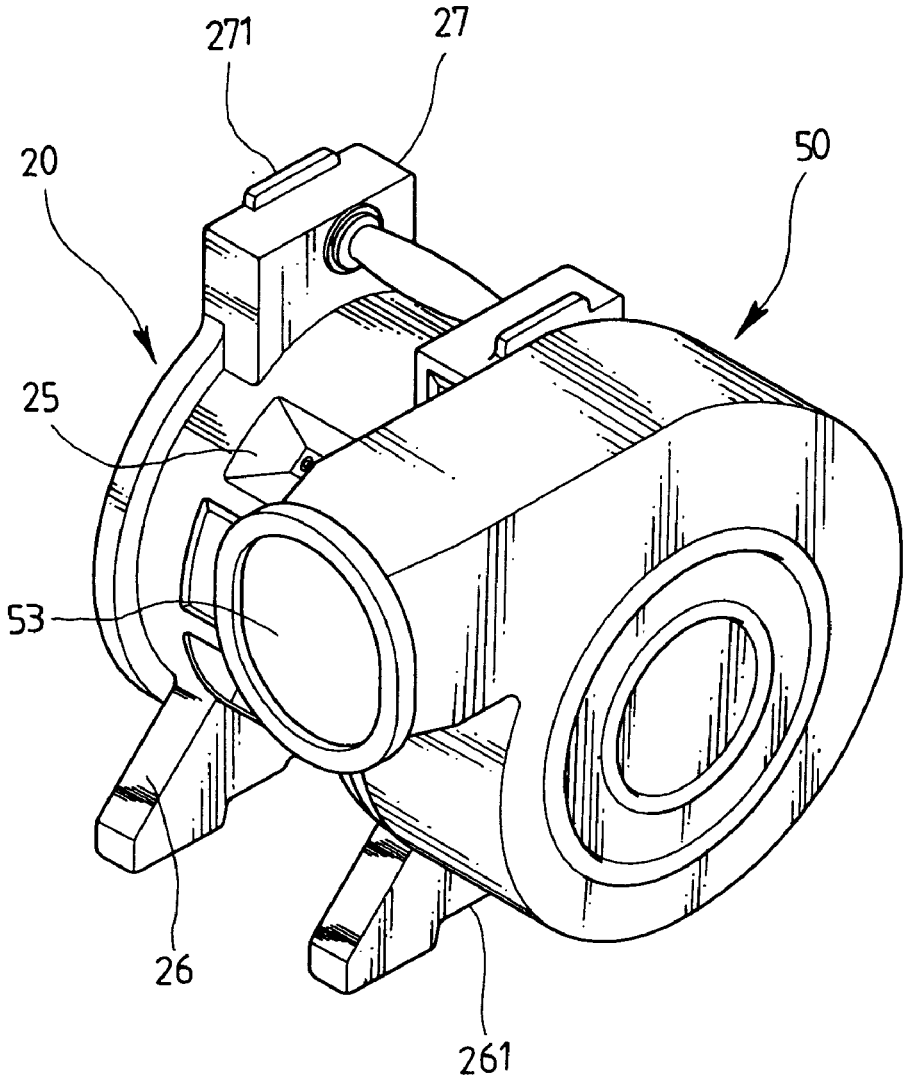
FIG. 3 is a perspective view to show the blower of the present invention.
Figure 4:
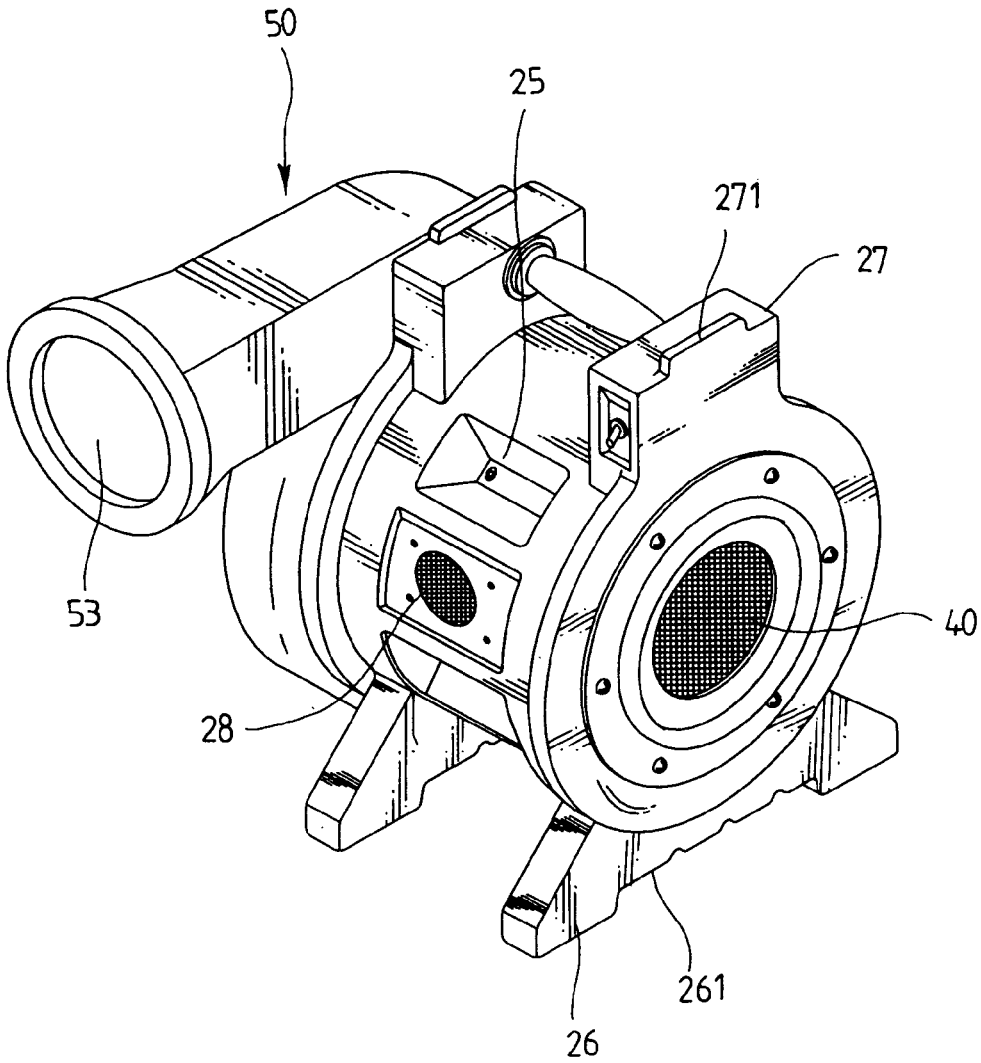
FIG. 4 is a perspective view to show the blower of the present invention, viewed from the other end of the blower.
Figure 5:
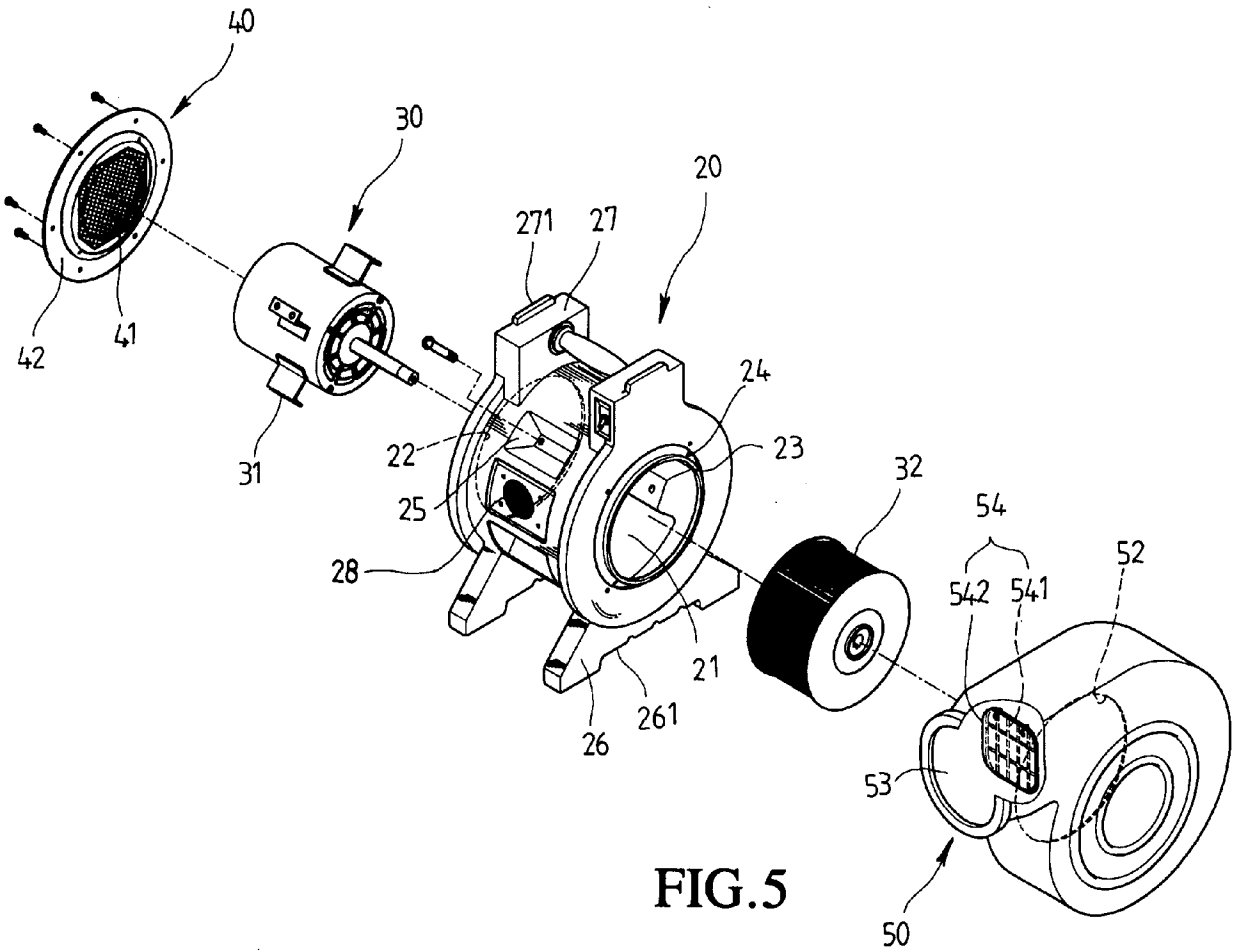
FIG. 5 is an exploded view to show the blower of the present invention.
Figure 6:
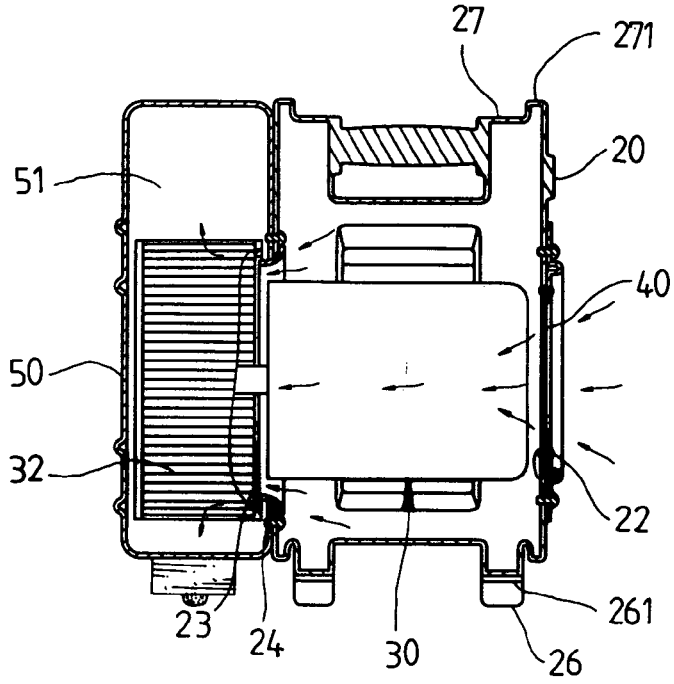
FIG. 6 is a side cross sectional view of the blower of the present invention.
Figure 7:
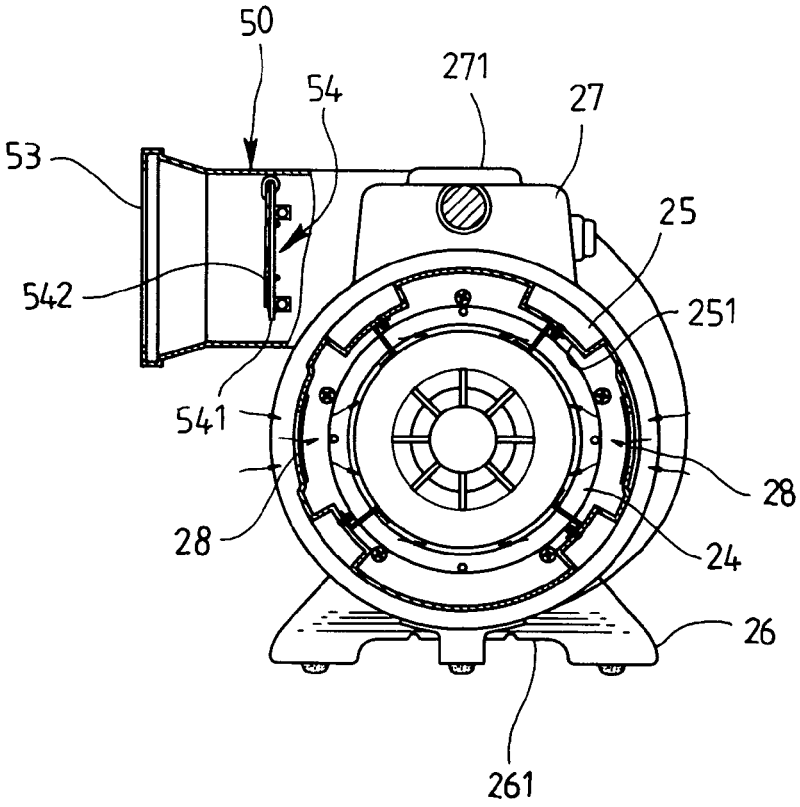
FIG. 7 is an end view of the blower of the present invention.

Referring to FIGS. 3 to 7, the blower of the present invention comprises a base 20 having a transverse passage 21 defined therethrough and the transverse passage 21 defines a first hole 22 and a second hole 23 through two opposite ends of the base 20. An inlet member 40 is connected to the base 20 and composed of a collar 42 and a screen 41 fixed to the collar 42. The inlet member 40 covers the first hole 22 of the base 20. A plurality of sub-inlets 28 with screens are defined through a wall of the base 20 and the sub-inlets 28 communicate with the transverse passage 21. A ring 24 is connected to the base 20 and encloses the second hole 23. The ring 24 includes a tapered outer periphery. The base 20 includes a plurality of recessed areas 25 on an outer periphery of the base 20 and each recessed area 25 forms a connection port 251 in an inner periphery of the transverse passage 21. A motor 30 is received in the transverse passage 21 and has lugs 31 which are fixed to the connection ports 251. A fan device 32 driven by the motor 30 extends from the second hole 23 and the tapered outer periphery of the ring 24 extends to an open end of the fan device 32.

Figure 10:
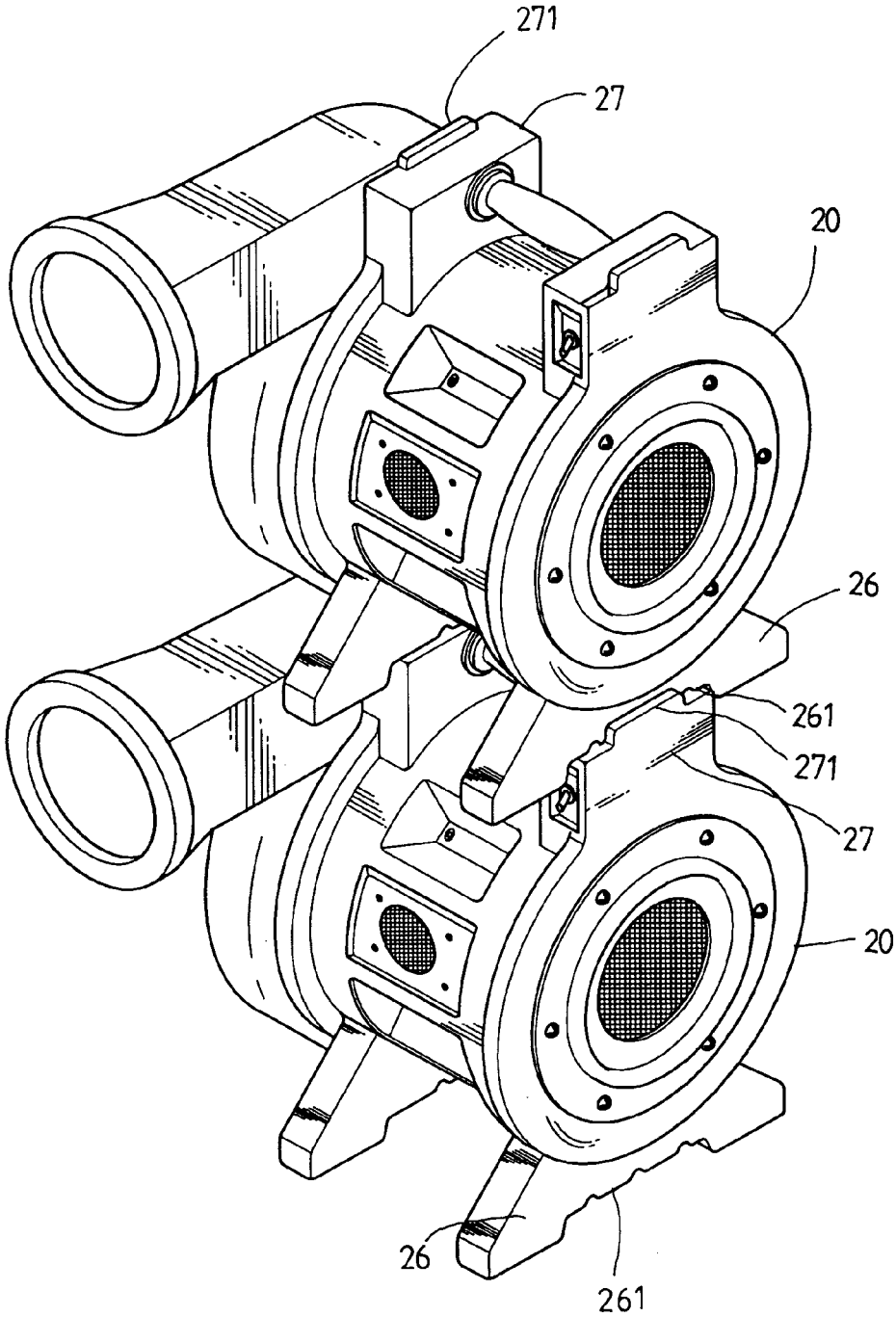
FIG. 10 shows two blowers are overlapped with each other.

Two support legs 26 are connected to the base 20 and each support leg 26 has a notch 261 defined in an underside thereof. Two top racks 27 are connected to the base 20 and located opposite to the support legs 26. A bar is connected between the two top racks 27 so that the user may conveniently carry the blower. The top racks 27 are sized to be engaged with the notches 261 in the support legs 26 as shown in FIG. 10 so as to reduce the space that the blowers occupy. Each top rack 27 includes a protrusion 271 extending from an outside surface thereof so that the protrusions 271 are hooked to an outside surface of the support lugs 26 of the top one blower as shown in FIG. 10.

Figure 8:
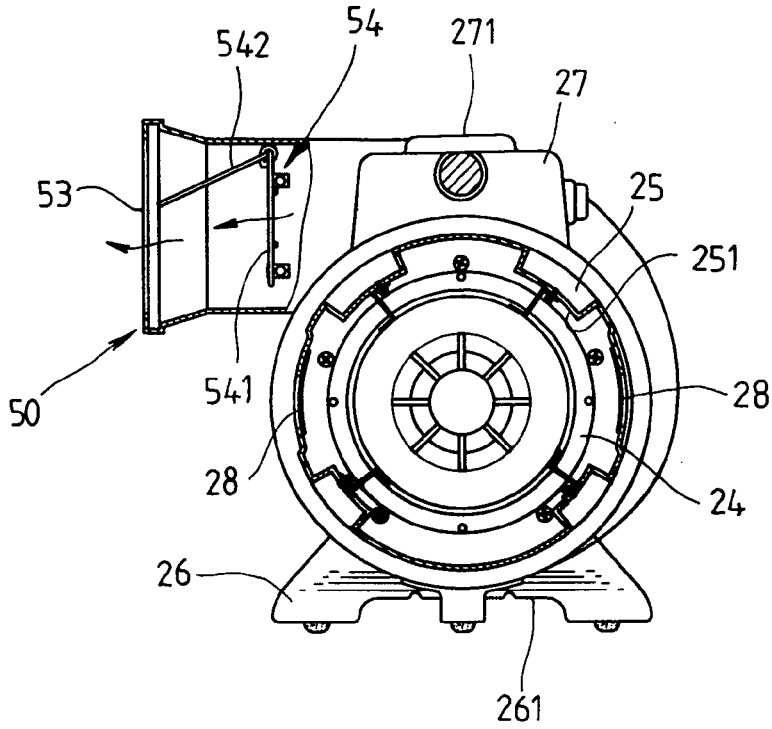
FIGS. 8 and 9 show the open and close positions of the plate of the anti-back device.
Figure 9:
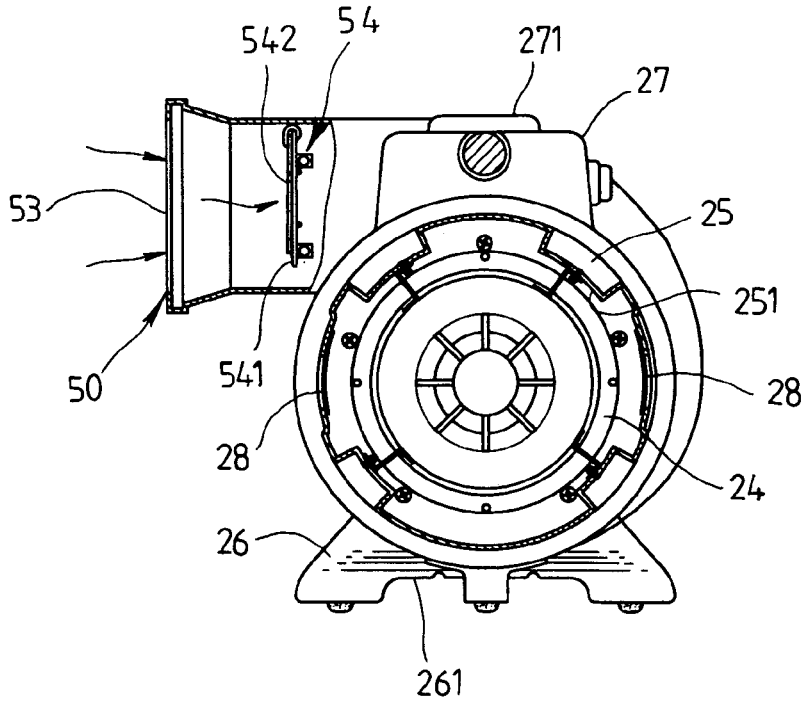

A casing 50 is connected to the base 20 and mounted to the fan device 32 via the hole 52 (FIG. 5) of the casing 50 so that the fan device 32 is received in the chamber 51 in the casing 50. The casing 50 includes an outlet 53 and an anti-back device 54 which is engaged in the outlet 53. Further referring to FIGS. 8 and 9, the anti-back device 54 having a frame 541 to which a plate 542 is pivotably connected. The frame 541 of the anti-back device 54 is composed of lattice and the plate 542 is pivotably connected to an edge of the frame 541. The plate 542 is opened in one direction when the air is sent by the fan device 32 so as to inflate an object such as a balloon, and seals the outlet 53 when air goes in opposite direction. When the fan device 32 is not in operative condition, the plate 542 seals the outlet 53 so as to prevent the air in the balloon from escaping via the outlet 53.

While we have shown and described the embodiment in accordance with the present invention, it should be clear to those skilled in the art that further embodiments may be made without departing from the scope of the present invention.

What is claimed is:

1. A blower comprising:

a base having a transverse passage defined therethrough and the transverse passage defining a first hole and a second hole in two opposite ends of the base, a motor having a shaft extending therefrom received in the transverse passage and a fan device coupled to the shaft to be driven by the motor extending from the second holes;

a ring being connected to the base and enclosing the second hole, the ring including a tapered outer periphery extending to an open end of the fan device; and a casing connected to the base and covering the fan device, the casing including an outlet and an anti-back device engaged in the outlet, the anti-back device having a frame to which a plate is pivotably connected, the plate being opened in one direction and sealing the outlet when in an opposite direction.

2. The blower as claimed in claim 1 further comprising an inlet member connected to the base and composed of a collar and a screen fixed to the collar, the inlet member covering the first hole of the base.

3. The blower as claimed in claim 1 further comprising a plurality of sub-inlets defined through a wall of the base and the sub-inlets communicating with the transverse passage.

4. A blower comprising:

a base having a transverse passage defined therethrough and the transverse passage defining a first hole and a second hole in two opposite ends of the base, a motor having a shaft extending therefrom received in the transverse passage and a fan device coupled to the shaft to be driven by the motor extending from the second hole;

two support legs connected to the base and each support leg having a notch defined in an underside thereof, two top racks connected to the base and located opposite to the support legs, the top racks being sized to be engaged with the notches in the support legs; and a casing connected to the base and covering the fan device, the casing including an outlet and an anti-back device engaged in the outlet, the anti-back device having a frame to which a plate is pivotably connected, the plate being opened in one direction and sealing the outlet when in an opposite direction.

5. The blower as claimed in claim 4, wherein each top rack includes a protrusion extending from an outside surface thereof and the protrusions are hooked to an outside surface of the support lugs when two blowers are overlapped with each other.

6. A blower comprising:

a base having a transverse passage defined therethrough and the transverse passage defining a first hole and a second hole in two opposite ends of the base, a motor having a shaft extending therefrom received in the transverse passage and a fan device coupled to the shaft to be driven by the motor extending from the second hole, the base including a plurality of recessed areas on an outer periphery of the base, each recessed area forming a connection port in an inner periphery of the transverse passage, the motor having lugs which are fixed to the connection ports; and a casing connected to the base and covering the fan device, the casing including an outlet and an anti-back device engaged in the outlet, the anti-back device having a frame to which a plate is pivotably connected, the plate being opened in one direction and sealing the outlet when in an opposite direction.

* * * * *